US006712711B1

(12) United States Patent
Skelton et al.

(10) Patent No.: US 6,712,711 B1
(45) Date of Patent: Mar. 30, 2004

(54) ENTERTAINING SYSTEM

(76) Inventors: James Skelton, 92 Steuben St., East Orange, NJ (US) 07018; Roscoe Seller, Jr., A-44 Woodside Ave., Roselle Park, NJ (US) 07204

( * ) Notice: Subject to any disclaimer, the term of this patent is extended or adjusted under 35 U.S.C. 154(b) by 20 days.

(21) Appl. No.: 10/159,051

(22) Filed: May 31, 2002

(51) Int. Cl.[7] ..... A63D 15/00; A63D 15/04; A47D 17/62

(52) U.S. Cl. ..... 473/10; 473/14; 108/11; 312/235.3; 312/107; 297/105; 297/118; 297/119; 273/309

(58) Field of Search ..... 473/1, 11, 14, 473/4, 6, 10, 3, 9, 18, FOR 1; 273/118 R, 118 A, 119 R, 119 A, 720 R, 720 A, 309; 297/118, 140, 144, 120, 135, 119, 121, 134, 105, 16.1, 2, 440.1; 312/235.1, 277, 237, 236, 235.3, 109, 281, 311, 312; 296/22; 108/59, 63, 11, 13

(56) References Cited

U.S. PATENT DOCUMENTS

| | | | | | |
|---|---|---|---|---|---|
| 100,401 | A | * | 3/1870 | Held | 473/11 |
| 193,156 | A | * | 7/1877 | Gardner | 473/10 |
| 227,179 | A | * | 5/1880 | Robbins | 312/226 |
| 470,206 | A | * | 3/1892 | Morrison | 312/217 |
| 512,337 | A | * | 1/1894 | Standen | 108/63 |
| 520,284 | A | * | 5/1894 | Wonson et al. | 297/145 |
| 614,722 | A | * | 11/1898 | Isaacs | 312/227 |
| 861,114 | A | * | 7/1907 | Harrild | 312/269 |
| 1,431,211 | A | * | 10/1922 | Bourke | 312/201 |
| 1,540,316 | A | | 6/1925 | Clement | |
| 1,543,980 | A | * | 6/1925 | Blood | 312/290 |
| 1,555,617 | A | * | 9/1925 | Anderson | 312/282 |
| 2,008,613 | A | * | 7/1935 | Hernes | 5/110 |
| 2,102,449 | A | * | 12/1937 | Zimmerman | 108/63 |
| 2,566,954 | A | * | 9/1951 | Murray | 312/203 |
| 2,572,333 | A | * | 10/1951 | Greitzer | 108/90 |
| D165,554 | S | * | 12/1951 | Schukat | D6/338 |
| 2,620,856 | A | * | 12/1952 | Gardner | 297/120 |
| 2,925,851 | A | * | 2/1960 | Weiss | 297/119 |
| 3,151,741 | A | * | 10/1964 | Haecker | 206/579 |
| 3,479,083 | A | * | 11/1969 | Lafer | 297/118 |
| 3,544,157 | A | * | 12/1970 | Muller | 297/118 |
| 3,711,099 | A | | 1/1973 | Milu | |
| 3,866,913 | A | * | 2/1975 | Zimmers et al. | 473/435 |
| 3,871,655 | A | | 3/1975 | Zimmers et al. | |
| 3,941,378 | A | | 3/1976 | Bagley | |
| 3,984,162 | A | * | 10/1976 | Zozzaro | 312/100 |
| 4,345,758 | A | | 8/1982 | Kempf | |
| 4,669,790 | A | * | 6/1987 | Briggs | 312/223.3 |
| 5,074,619 | A | * | 12/1991 | D'Orsi et al. | 297/236 |
| 5,085,608 | A | * | 2/1992 | Turner | 446/75 |
| 5,833,306 | A | | 11/1998 | Breto | |

FOREIGN PATENT DOCUMENTS

| | | | | |
|---|---|---|---|---|
| FR | 778766 A | * | 3/1935 | 473/FOR 10 |
| FR | 780640 | * | 4/1935 | |
| FR | 833518 A | * | 10/1938 | 473/FOR 10 |

* cited by examiner

*Primary Examiner*—Mark S. Graham
*Assistant Examiner*—Mitra Aryanpour

(57) ABSTRACT

A entertaining system for entertaining guests. The entertaining system includes a buffet assembly comprising a main member and a plurality of drawers. Each of the drawers is extendable into the main member whereby each of the drawers is designed for storing items. The main member of the buffet assembly is designed for supporting food items to be served to the guests. A cabinet member comprises a perimeter wall. The perimeter wall defines an interior space. The cabinet member comprises at least one shelf portion. The shelf portion is designed for supporting tableware whereby the tableware is stored in the interior space of the cabinet member. A table assembly comprises a top member and a plurality of leg members. Each of the leg members downwardly extends from the top member whereby the leg members are designed for engaging a support surface for supporting the top member above the support surface.

16 Claims, 6 Drawing Sheets

ENTERTAINING SYSTEM

BACKGROUND OF THE INVENTION

1. Field of the Invention

The present invention relates to transformable furniture and more particularly pertains to a new entertaining system for entertaining guests.

2. Description of the Prior Art

The use of transformable furniture is known in the prior art. U.S. Pat. No. 5,833,306 describes a device that is transformable between a chair , a table, a bar and an ironing board. Another type of transformable furniture is U.S. Pat. No. 3,941,378 having a pool table that is convertible into a dining table. U.S. Pat. No. 1,540,316 has a combination dining and billiard table for allow a user to dine on the table and then play pool. U.S. Pat. No. 4,245,758 has a convertible table for playing games. U.S. Pat. No. 3,871,655 has a convertible game table assembly for converting between a table, a gaming table and a pool table. U.S. Pat. No. 3,711,099 has a table that is convertible for playing games and bumper pool.

While these devices fulfill their respective, particular objectives and requirements, the need remains for a system that has certain improved features allowing guests to play a game of pinball.

SUMMARY OF THE INVENTION

The present invention meets the needs presented above by providing a buffet assembly that is convertible into pinball machine and a separate dart game.

Still yet another object of the present invention is to provide a new entertaining system that allows a user to entertain a plurality of guests.

To this end, the present invention generally comprises a buffet assembly comprising a main member and a plurality of drawers. Each of the drawers is extendable into the main member whereby each of the drawers is designed for storing items for entertaining guests. The main member of the buffet assembly is designed for supporting food items to be served to the guests. A cabinet member comprises a perimeter wall. The perimeter wall defines an interior space. The cabinet member comprises at least one shelf portion being coupled to the perimeter wall in the interior space of the cabinet member. The shelf portion is designed for supporting tableware whereby the tableware is stored in the interior space of the cabinet member when food items are not being served. A table assembly comprises a top member and a plurality of leg members. Each of the leg members downwardly extend from the top member whereby the leg members are designed for engaging a support surface for supporting the top member above the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
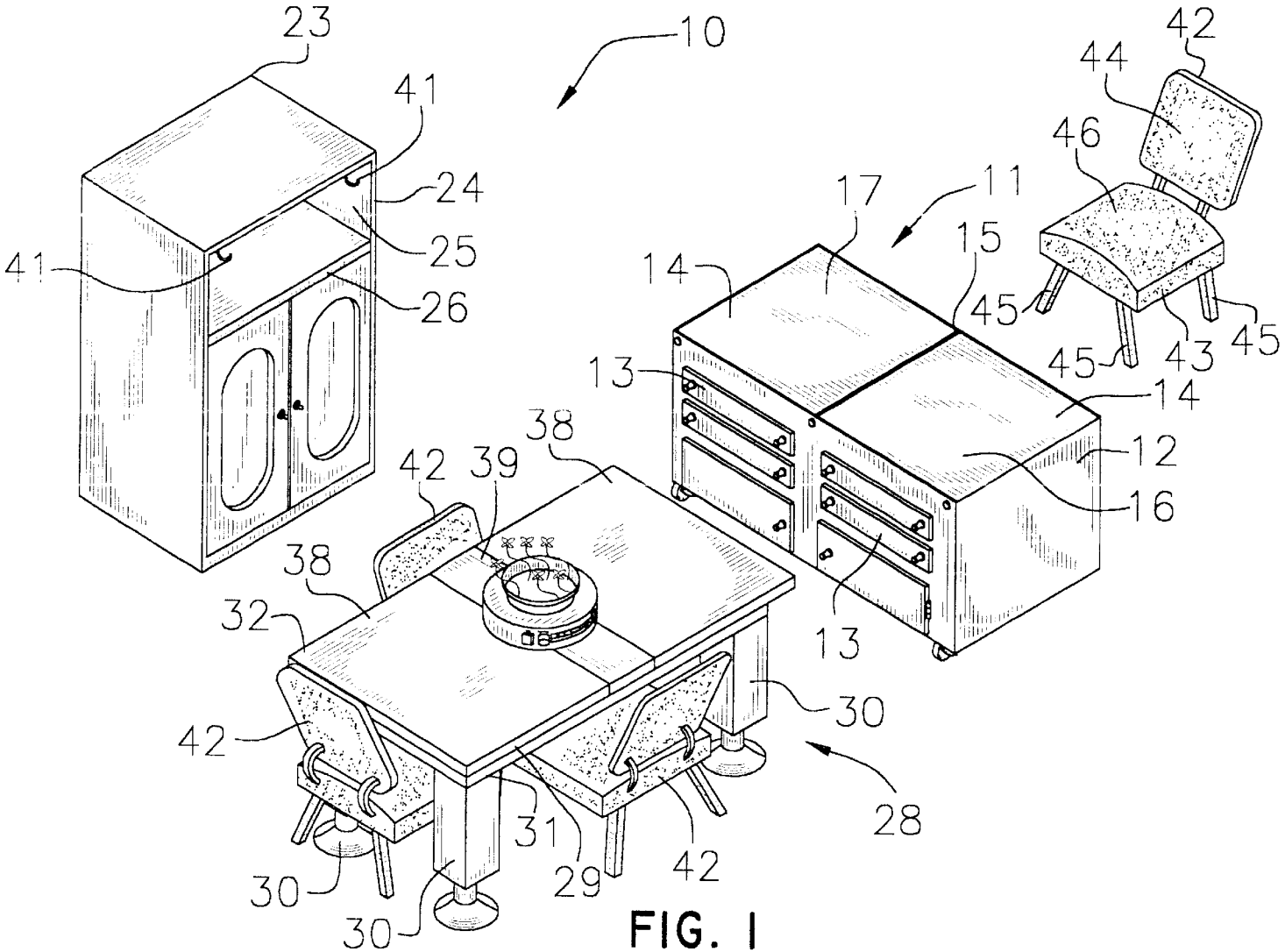
FIG. 1 is a perspective view of a new entertaining system according to the present invention.
Figure 2:
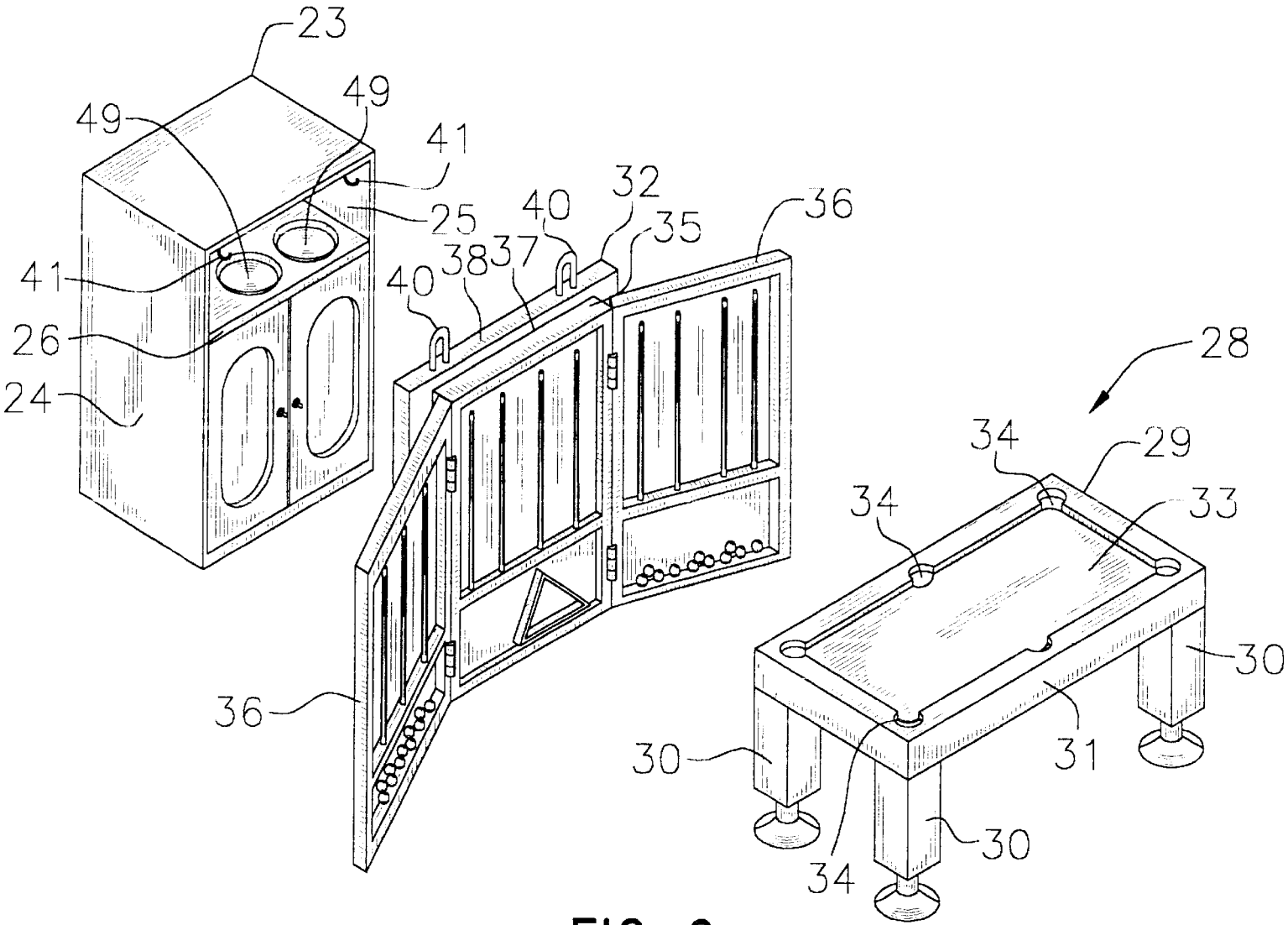
FIG. 2 is a perspective view of the table assembly and the cabinet member of the present invention the table top portion separated from the base portion.
Figure 3:
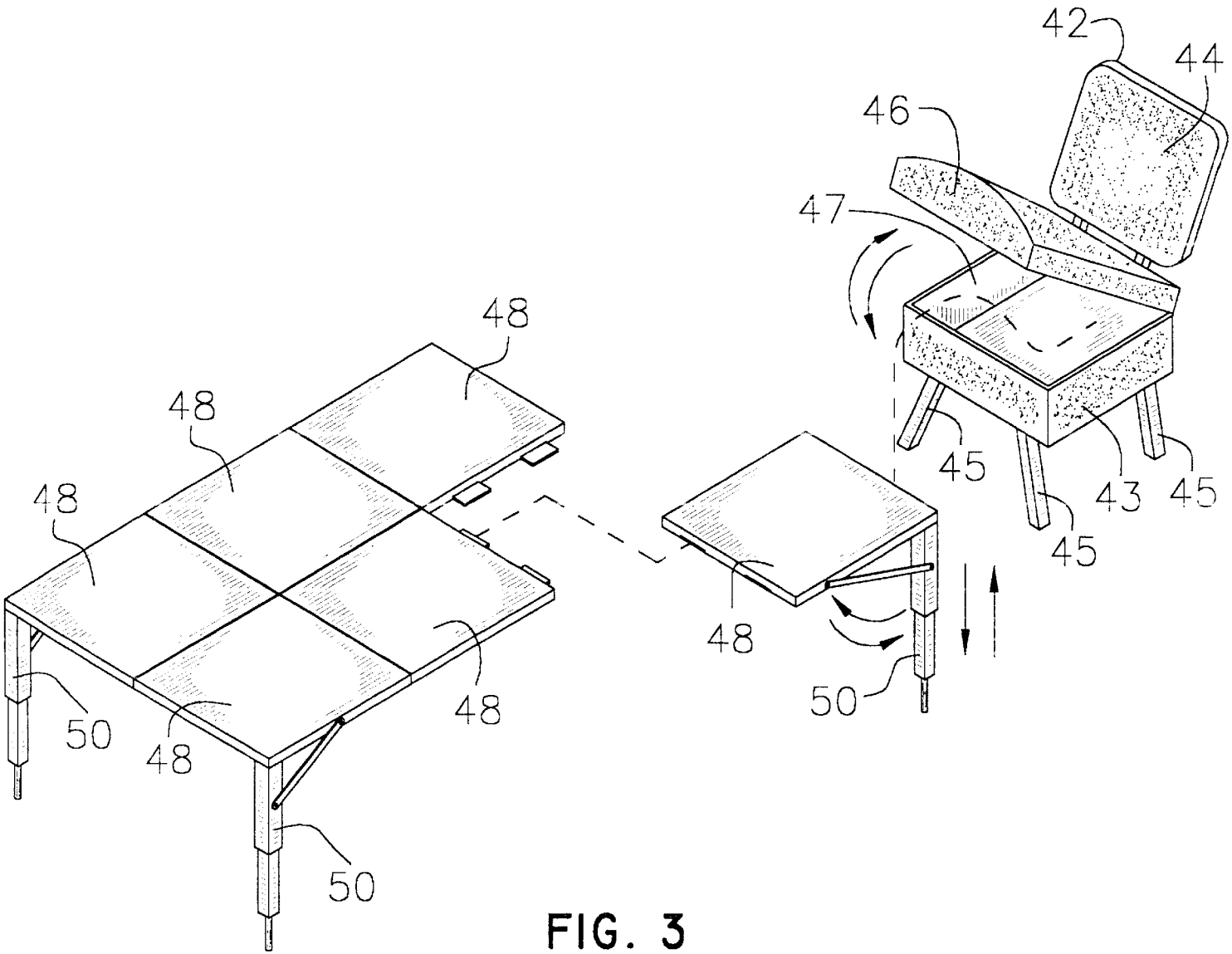
FIG. 3 is a perspective view of one of the chair members and the panel members of the present invention.
Figure 4:
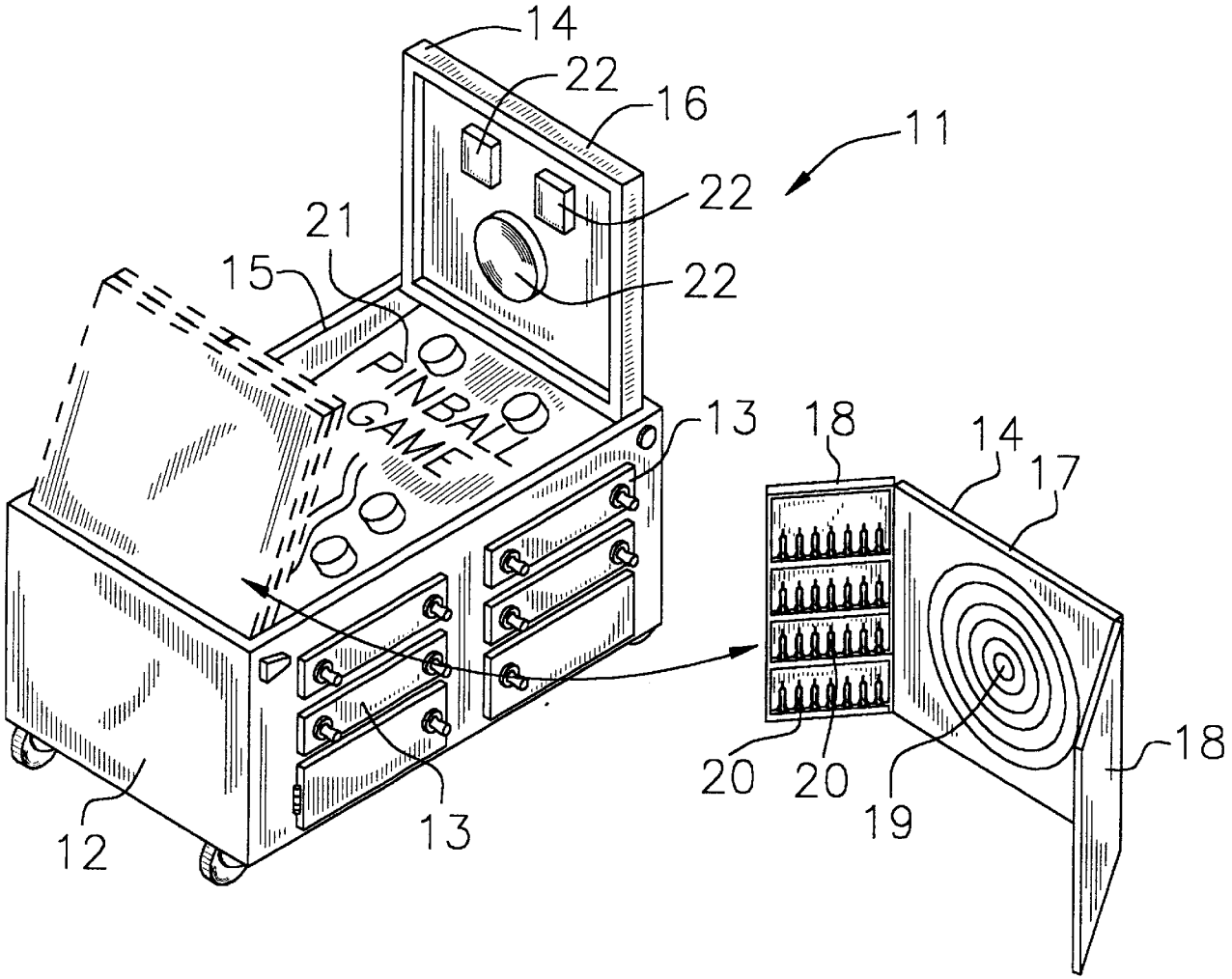
FIG. 4 is a perspective view of the buffet assembly of the present invention.
Figure 5:
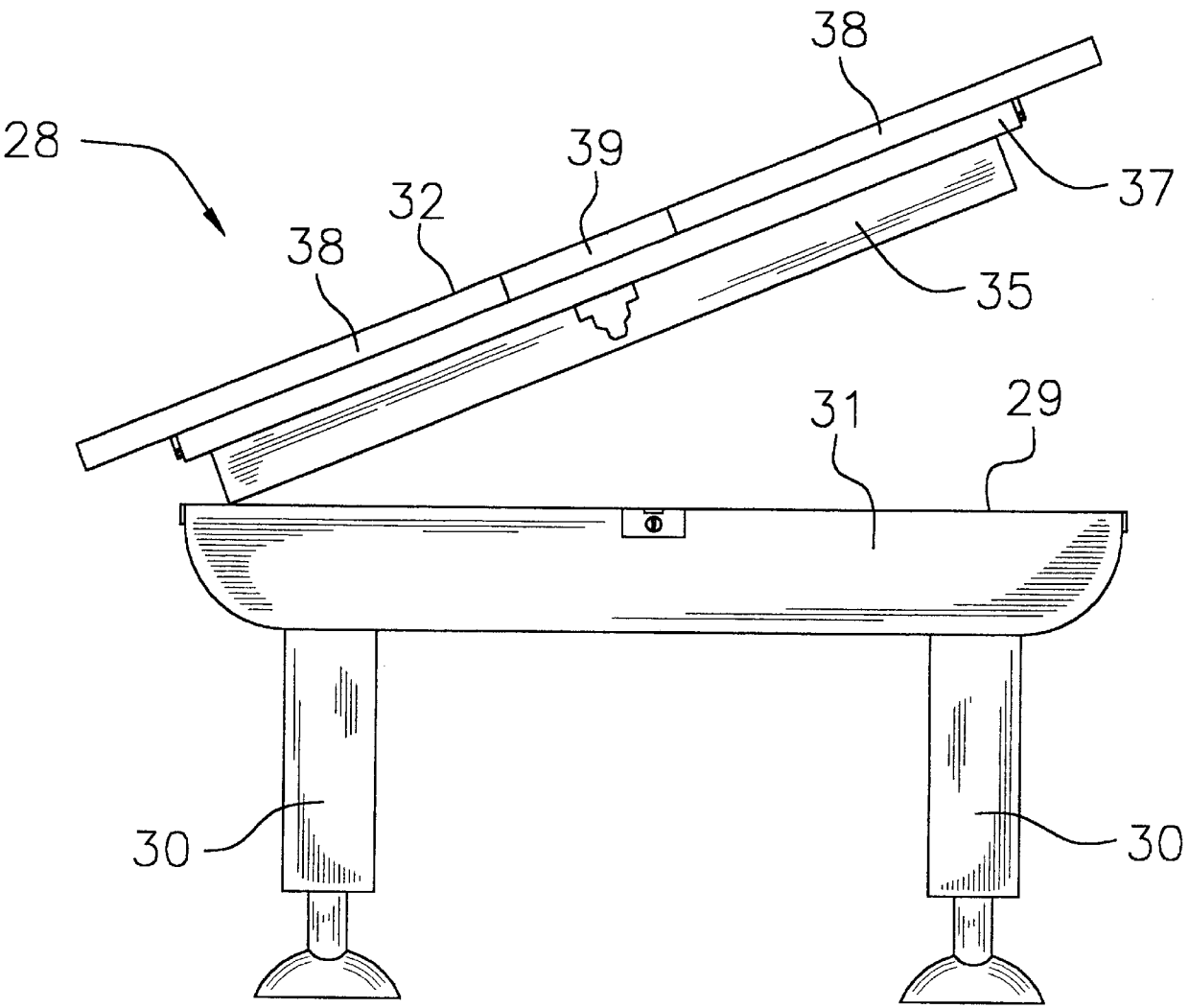
FIG. 5 is a side view of the table assembly of the present invention.
Figure 6:
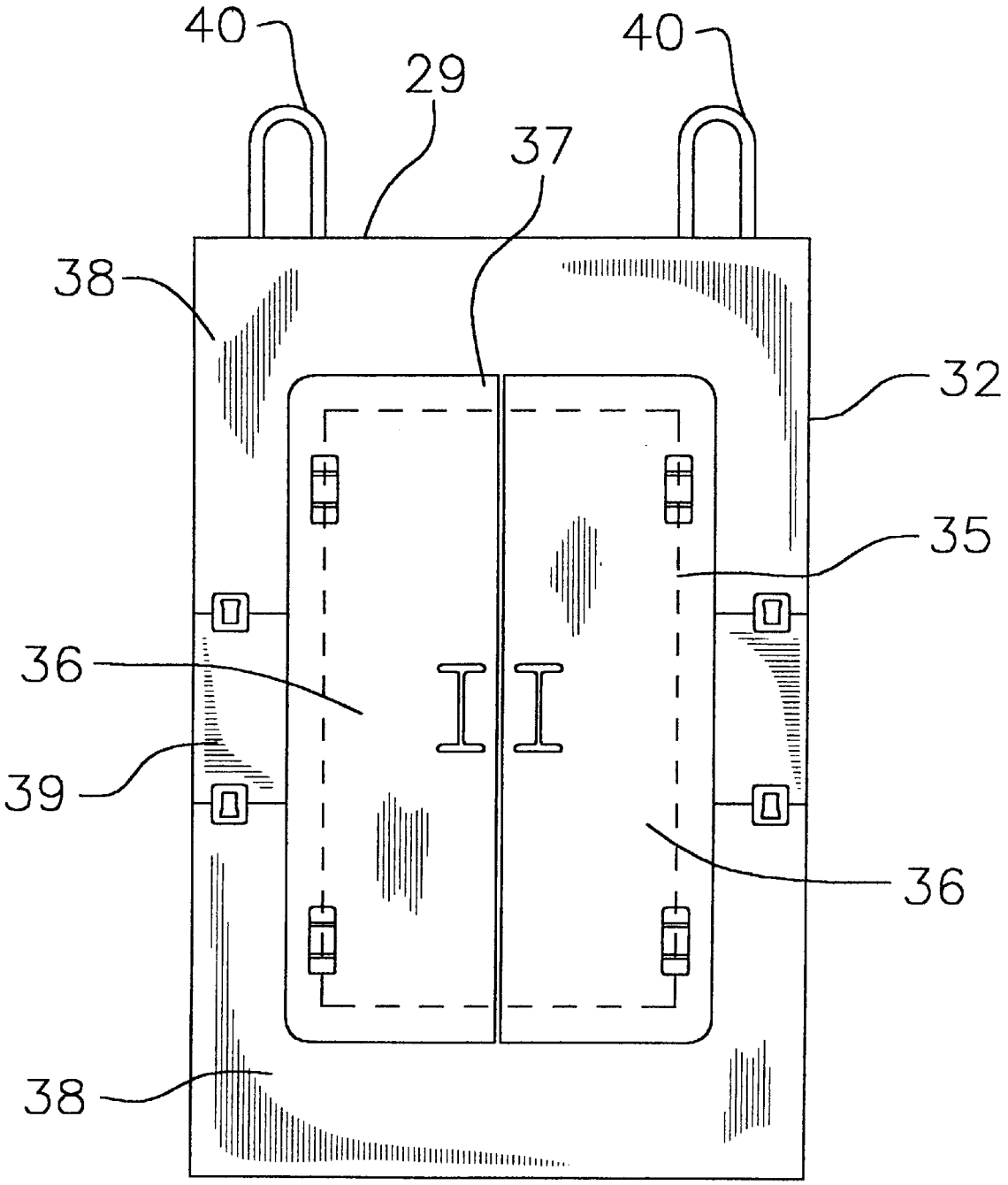
FIG. 6 is a bottom view of the table top portion of the table assembly of the present invention.

With reference now to the drawings, and in particular to FIGS. 1 through 6 thereof, a new entertaining system embodying the principles and concepts of the present invention and generally designated by the reference numeral 10 will be described. for the purposes of this disclosure the term "couplable" is defined as "capable of being coupled".

As best illustrated in FIGS. 1 through 6, the entertaining system 10 generally comprises a buffet assembly 11 comprising a main member 12 and a plurality of drawers 13. Each of the drawers 13 is extendable into the main member 12 whereby each of the drawers 13 is designed for storing items for entertaining guests. The main member 12 of the buffet assembly 11 is designed for supporting food items to be served to the guests.

The main member 12 of the buffet assembly 11 comprises a pair of upper walls 14 selectively positionable adjacent an upper edge 15 of a peripheral wall of the main member 12. A first upper wall 16 of the upper walls 14 is pivotally coupled to the peripheral wall of the main member 12 whereby the first upper wall 16 is pivotal to an upright position with respect to the peripheral wall of the main member 12.

A second upper wall 17 of the upper walls 14 is removable from the main member 12 of the buffet assembly 11. A pair of flap members 18 are pivotally coupled to the second upper wall 17. A dart board 19 is positioned in the second upper wall 17. Each of the flap member 18 holds a-plurality of dart objects 20 whereby the dart objects 20 are for playing a game of darts.

The buffet assembly 11 comprises a pinball game assembly 21. The pinball game assembly 21 is positioned in the main member 12 of the buffet assembly 11 whereby the pinball game assembly 21 is designed for being actuated by one of the guests for playing a game of pinball. A plurality of display members 22 are coupled to the first upper wall 16. The display members 22 are operationally coupled to the pinball game assembly 21 for displaying scores attained when the guests play a game of pinball.

A cabinet member 23 comprises a perimeter wall 24. The perimeter wall 24 defines an interior space 25. The cabinet member 23 comprises at least one shelf portion 26 being coupled to the perimeter wall 24 in the interior space 25 of the cabinet member 23. The shelf portion 26 is designed for supporting tableware 49 whereby the tableware 49 is stored in the interior space 25 of the cabinet member 23 when food items are not being served.

A table assembly 28 comprises a top member 29 and a plurality of leg members 30. Each of the leg members 30 downwardly extend from the top member 29 whereby the leg members 30 are designed for engaging a support surface for supporting the top member 29 above the support surface.

The top member 29 of the table assembly 28 comprises a base portion 31 and table top portion 32. The base portion 31 is coupled to the leg members 30. The table top portion 32 is selectively couplable to the base portion 31 whereby the table top member 29 is designed for supporting the tableware 49 when the guests are eating. The base portion 31 of the top member 29 has a recessed area 33. The base portion 31 has a plurality of pockets 34 in communication with the recessed area 33 of the base portion 31 of the top member 29 whereby the pockets 34 and the recessed area 33 are designed for permitting guests to play a game of billiards when the table top portion 32 is removed from the base portion 31.

The table top portion 32 of the top member 29 comprises a storage case 35. The storage case 35 is positionable in the recessed area 33 of the base portion 31 when the table top portion 32 is coupled to the base portion 31. A pair of door members 36 are hingably coupled to the storage case 35 whereby the door members 36 and the storage case 35 are for storing billiard items to be used when the guests are playing a game of billiards.

The table top portion 32 of the top member 29 comprises a track assembly 37. The track assembly 37 is coupled to the storage case 35 opposite the door members 36.

The table top portion 32 of the top member 29 comprises a pair of panels 38. Each of the panels 38 is slidably coupled to the track assembly 37. The panels 38 are slidable with respect to the storage case 35 whereby a leaf member 39 is selectively insertable between the panels 38 when the panels 38 are slid apart for extending a length of the table top portion 32 to accommodate a greater number of guests.

The table top portion 32 of the top member 29 comprises a plurality of hanger members 40. Each of the hanger members 40 selectively engages one of a plurality of hook members 41 of the cabinet member 23 whereby the table top portion 32 of the top member 29 can be suspended from the cabinet member 23 when the table top portion 32 of disengaged from the base portion 31.

A plurality of chair members 42 each is selectively positionable under the top member 29 of the table assembly 28. Each of the chair members 42 is designed for supporting one of the guests when the guests are sitting at the table assembly 28.

Each of the chair members 42 comprises a seat portion 43 and a back portion 4. The seat portion 43 of each of the chair member is designed for supporting one of the guests when the associated one of the guests is seated on the seat portion 43. The back portion 44 of each of the chair members 42 is designed for supporting a back of one of the guests when the associated one of the guests in seated on the s at portion 43 of the associated one chair members 42.

Each of the chair members 42 comprises a plurality of support portions 45. Each of the support portions 45 downwardly extends from the seat portion 43 of the associated one of the chair members 42 whereby each of the support portions 45 is designed for supporting the seat portion 43 above the support surface.

Each of the chair members 42 comprises a cushion portion 46. The cushion portion 46 is selectively coupled to the set portion of the associated one of the chair members 42. The cushion portion 46 comprises a padded material whereby the padded material is designed for providing cushioning to one of the guests when the associated one of the guests is seated on the associated one of the chair members 42.

The seat portion 43 of each of the chair members 42 defining a cavity 47. The cushion portion 46 of the associated one of the chair members 42 is for closing the cavity 47 when the cushion portion 46 is coupled to the seat portion 43.

A plurality of panel members 48 are selectively positionable in the cavity 47 of the seat portion 43 of the chair members 42. The panel members 48 are couplable to form a table 49 when the panel members 48 are removed from the cavity 47 of the seat portion 43 of the chair members 42.

A plurality of the panel members 48 each comprise a stanchion 50 pivotally coupled to a bottom surface of the associated one of the panel members 48. The stanchion 50 downwardly extends from the panel members 48 whereby the stanchion 50 of the panel members 48 is designed for supporting the panel members 48 above the support surface when the panel members 48 have been coupled together. The stanchion 50 of the associated panel members 48 is telescopic for selectively adjusting a length of the stanchion 50.

In use, the user can take the tableware 49 from the cabinet member 23 and place it on the top member 29 of the table assembly 28. Food items can then be placed on the buffet assembly 11 to allow the guests the collect food to eat while they are sitting at the table assembly 28. The table top portion 32 of the top member 29 of the table assembly 28 can be removed from the base portion 31 of said top member 29 to expose the recessed area 33 and the pockets 34 for allowing the guests to play a game of billiards with the billiard items contained in the storage case 35 of the table top portion 32 of the top member 29. The second upper wall 17 of the buffet assembly 11 can be removed and opened to expose a dart board 19 and dart items for playing a game of darts. The first upper wall 16 of the buffet assembly 11 can be pivoted to a vertical position to allow the guest to play the pinball assembly positioned in the main member 12 of the buffet assembly 11. The cushion portion 46 of the each of the chair members 42 can be lifted to expose a plurality of panel members 48 that can be coupled together to for a table 49 to play cards.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An entertaining system for entertaining guests, the entertaining system comprising:

a buffet assembly comprising a main member and a plurality of drawers, each of said drawers being extendable into said main member such that each of said drawers is adapted for storing items for entertaining guests, said main member of said buffet assembly being adapted for supporting food items to be served to the guests;

a table assembly comprising a top member and a plurality of leg members, each of said leg members downwardly extending from said top member such that said leg members are adapted for engaging a support surface for supporting said top member above the support surface;

a cabinet member comprising a perimeter wall, said perimeter wall defining an interior space, said cabinet member comprising at least one shelf portion being coupled to said perimeter wall in said interior space of said cabinet member, said shelf portion being adapted for supporting tableware such that the tableware is stored in said interior space of said cabinet member when food items are not being served;

said main member of said buffet assembly comprising a pair of upper walls being selectively positionable adjacent an upper edge of a peripheral wall of said main member, a first upper wall of said upper walls being pivotally coupled to said peripheral wall of said main member such that said first upper wall is pivotal to an upright position with respect to said peripheral wall of said main member; and said buffet assembly comprising a pinball game assembly, said pinball game assembly being positioned in said main member of said buffet assembly such that said pinball game assembly is adapted for being actuated by one of the guests for playing a game of pinball a plurality of display members being coupled to said first upper wall, said display members being operationally coupled to said pinball game assembly for displaying scores attained when the guests play a game of pinball.

2. The entertaining system as set forth in claim 1, further comprising:

a plurality of chair members each being selectively positionable under said top member of said table assembly, each of said chair members being adapted for supporting one of the guests when the guests are sitting at said table assembly.

3. The entertaining system as set forth in claim 2, further comprising:

each of said chair members comprising a seat portion and a back portion, said seat portion of each of said chair member being adapted for supporting one of the guests when the associated one of the guests is seated on said seat portion, said back portion of each of said chair members being adapted for supporting a back of one of the guests when the associated one of the guests in seated on said seat portion of the associated one chair members.

4. The entertaining system as set forth in claim 3, further comprising:

each of said chair members comprising a plurality of support portions, each of said support portions downwardly extending from said seat portion of the associated one of said chair members such that each of said support portions is adapted for supporting said seat portion above the support surface.

5. The entertaining system as set forth in claim 3, further comprising:

each of said chair members comprising a cushion portion, said cushion portion being selectively coupled to said seat portion of the associated one of said chair members, said cushion portion comprising a padded material such that said padded material is adapted for providing cushioning to one of the guests when the associated one of the guests is seated on the associated one of said chair members.

6. The entertaining system as set forth in claim 5, further comprising:

said seat portion of each of said chair members defining a cavity, said cushion portion of the associated one of said chair members being for closing said cavity when said cushion portion is coupled to said seat portion;

a plurality of panel members being selectively positionable in said cavity of said seat portion of said chair members, said panel members being couplable to form a table when said panel members are removed from said cavity of said seat portion of said chair members.

7. The entertaining system as set forth in claim 6, further comprising:

a plurality of said panel members comprising a stanchion pivotally coupled to a bottom surface of the associated one of said panel members, said stanchion downwardly extending from said panel members such that said stanchion of said panel members is adapted for supporting said panel members above the support surface when said panel members have been coupled together.

8. The entertaining system as set forth in claim 1, further comprising:

a second upper wall of said upper walls being removable from said main member of said buffet assembly, a pair of flap members being pivotally coupled to said second upper wall, a dart board being positioned in said second upper wall, each of said flap members holding a plurality of dart objects such that said dart objects are for playing a game of darts.

9. The entertaining system as set forth in claim 1, further comprising:

said top member of said table assembly comprising a base portion and table top portion, said base portion being coupled to said leg members, said table top portion being selectively couplable to said base portion such that said table top member is adapted for supporting the tableware when the guests are eating, said base portion of said top member having a recessed area, said base portion having a plurality of pockets in communication with said recessed area of said base portion of said top member such that said pockets and said recessed area are adapted for permitting guests to play a game of billiards when said table top portion is removed from said base portion.

10. The entertaining system as set forth in claim 9, further comprising:

said table top portion of said top member comprising a storage case, said storage case being positionable in said recessed area of said base portion when said table top portion is coupled to said base portion, a pair of door members being hingably coupled to said storage case such that said door members and said storage case are for storing billiard items to be used when the guests are playing a game of billiards.

11. The entertaining system as set forth in claim 10, further comprising:

said table top portion of said top member comprising a track assembly, said track assembly being coupled to said storage case opposite said door members;

said table top portion of said top member comprising a pair of panels, each of said panels being slidably coupled to said track assembly, said panels being slidable with respect to said storage case such that a leaf member is selectively.insertable between said panels when said panels are slid apart for extending a length of said table top portion to accommodate a greater number of guests.

12. The entertaining system as set forth in claim 9, further comprising:

said table top portion of said top member comprising a plurality of hanger members, each of said hanger members selectively engaging one of a plurality of hook members of said cabinet member such that said table top portion of said top member can be suspended from said cabinet member when said table top portion is disengaged from said base portion.

13. An entertaining system for entertaining guests, the entertaining system comprising:

a buffet assembly comprising a main member and a plurality of drawers, each of said drawers being extendable into said main member such that each of said drawers is adapted for storing items for entertaining guests, said main member of said buffet assembly being adapted for supporting food items to be served to the guests;

said main member of said buffet assembly comprising a pair of upper walls being selectively positionable adjacent an upper edge of a peripheral wall of said main member, a first upper wall of said upper walls being pivotally coupled to said peripheral wall of said main member such that said first upper wall is pivotal to an upright position with respect to said peripheral wall of said main member;

a second upper wall of said upper walls being removable from said main member of said buffet assembly, a pair of flap members being pivotally coupled to said second upper wall, a dart board being positioned in said second upper wall, each of said flap members holding a plurality of dart objects such that said dart objects are for playing a game of darts;

said buffet assembly comprising a pinball game assembly, said pinball game assembly being positioned in said main member of said buffet assembly such that said pinball game assembly is adapted for being actuated by one of the guests for playing a game of pinball, a plurality of display members being coupled to said first upper wall, said display members being operationally coupled to said pinball game assembly for displaying scores attained when the guests play a game of pinball;

a cabinet member comprising a perimeter wall, said perimeter wall defining an interior space, said cabinet member comprising at least one shelf portion being coupled to said perimeter wall in said interior space of said cabinet member, said shelf portion being adapted for supporting tableware such that the tableware is stored in said interior space of said cabinet member when food items are not being served;

a table assembly comprising a top member and a plurality of leg members, each of said leg members downwardly extending from said top member such that said leg members are adapted for engaging a support surface for supporting said top member above the support surface;

said top member of said table assembly comprising a base portion and table top portion, said base portion being coupled to said leg members, said table top portion being selectively couplable to said base portion such that said table top member is adapted for supporting the tableware when the guests are eating, said base portion of said top member having a recessed area, said base portion having a plurality of pockets in communication with said recessed area of said base portion of said top member such that said pockets and said recessed area are adapted for permitting guests to play a game of billiards when said table top portion is removed from said base portion;

said table top portion of said top member comprising a storage case, said storage case being positionable in said recessed area of said base portion when said table top portion is coupled to said base portion, a pair of door members being hingably coupled to said storage case such that said door members and said storage case are for storing billiard items to be used when the guests are playing a game of billiards;

said table top portion of said top member comprising a track assembly, said track assembly being coupled to said storage case opposite said door members;

said table top portion of said top member comprising a pair of panels, each of said panels being slidably coupled to said track assembly, said panels being slidable with respect to said storage case such that a leaf member is selectively insertable between said panels when said panels are slid apart for extending a length of said table top portion to accommodate a greater number of guests;

said table top portion of said top member comprising a plurality of hanger members, each of said hanger members selectively engaging one of a plurality of hook members of said cabinet member such that said table top portion of said top member can be suspended from said cabinet member when said table top portion of disengaged from said base portion;

a plurality of chair members each being selectively positionable under said top member of said table assembly, each of said chair members being adapted for supporting one of the guests when the guests are sitting at said table assembly;

each of said chair members comprising a seat portion and a back portion, said seat portion of each of said chair member being adapted for supporting one of the guests when the associated one of the guests is seated on said seat portion, said back portion of each of said chair members being adapted for supporting a back of one of the guests when the associated one of the guests in seated on said seat portion of the associated one chair members;

each of said chair members comprising a plurality of support portions, each of said support portions downwardly extending from said seat portion of the associated one of said chair members such that each of said support portions is adapted for supporting said seat portion above the support surface;

each of said chair members comprising a cushion portion, said cushion portion being selectively coupled to said seat portion of the associated one of said chair members, said cushion portion comprising a padded material such that said padded material is adapted for providing cushioning to one of the guests when the associated one of the guests is seated on the associated one of said chair members;

said seat portion of each of said chair members defining a cavity, said cushion portion of the associated one of said chair members being for closing said cavity when said cushion portion is coupled to said seat portion;

a plurality of panel members being selectively positionable in said cavity of said seat portion of said chair members, said panel members being couplable to form a table when said panel members are removed from said cavity of said seat portion of said chair members; and a plurality of said panel members each comprising a stanchion pivotally coupled to a bottom surface of the associated one of said panel members, said stanchion downwardly extending from said panel members such that said stanchion of said panel members is adapted for supporting said panel members above the support surface when said panel members have been coupled together.

14. An entertaining system for entertaining guests, the entertaining system comprising:

a buffet assembly comprising a main member and a plurality of drawers, each of said drawers being extendable into said main member such that each of said drawers is adapted for storing items for entertaining guests, said main member of said buffet assembly being adapted for supporting food items to be served to the guests;

a table assembly comprising a top member and a plurality of leg members, each of said leg members downwardly extending from said top member such that said leg members are adapted for engaging a support surface for supporting said top member above the support surface;

a cabinet member comprising a perimeter wall, said perimeter wall defining an interior space, said cabinet member comprising at least one shelf portion being coupled to said perimeter wall in said interior space of said cabinet member, said shelf portion being adapted for supporting tableware such that the tableware is stored in said interior space of said cabinet member when food items are not being served;

said top member of said table assembly comprising a base portion and table top portion, said base portion being coupled to said leg members, said table top portion being selectively couplable to said base portion such that said table top member is adapted for supporting the tableware when the guests are eating, said base portion of said top member having a recessed area, said base portion having a plurality of pockets in communication with said recessed area of said base portion of said top member such that said pockets and said recessed area are adapted for permitting guests to play a game of billiards when said table top portion is removed from said base portion; and said table top portion of said top member comprising a plurality of hanger members, each of said hanger members selectively engaging one of a plurality of hook members of said cabinet member such that said table top portion of said top member can be suspended from said cabinet member when said table top portion is disengaged from said base portion.

15. The entertaining system as set forth in claim 14, further comprising:

said table top portion of said top member comprising a storage case, said storage case being positionable in said recessed area of said base portion when said table top portion is coupled to said base portion, a pair of door members being hingably coupled to said storage case such that said door members and said storage case are for storing billiard items to be used when the guests are playing a game of billiards.

16. The entertaining system as set forth in claim 15, further comprising:

said table top portion of said top member comprising a track assembly, said track assembly being coupled to said storage case opposite said door members;

said table top portion of said top member comprising a pair of panels, each of said panels being slidably coupled to said track assembly, said panels being slidable with respect to said storage case such that a leaf member is selectively insertable between said panels when said panels are slid apart for extending a length of said table top portion to accommodate a greater number of guests.

* * * * *